US005628545A

United States Patent [19]

Perthuis et al.

[11] Patent Number: 5,628,545

[45] Date of Patent: May 13, 1997

[54] METHOD AND A COVER FOR COVERING A CUSHION OF A MOTOR VEHICLE SEAT

[75] Inventors: Jean M. Perthuis, Beuille le Comte; Pascal Lhuissier, Beaugency; Alain Y. Le-Breton, Ville D'Avray, all of France

[73] Assignee: Bertrand Faure Automobile "BFA", France

[21] Appl. No.: 568,795

[22] Filed: Dec. 7, 1995

Related U.S. Application Data

[63] Continuation of Ser. No. 148,436, Nov. 8, 1993, abandoned.

[30] Foreign Application Priority Data

Nov. 6, 1992 [FR] France ..... 92 13404

[51] Int. Cl.[6] ..... A47C 31/00

[52] U.S. Cl. ..... 297/228.11; 297/219.1; 297/452.58

[58] Field of Search ..... 297/228.11, 218.4, 297/218.5, 219.1, 452.1, 452.38, 452.58, 452.59, 452.62

[56] References Cited

U.S. PATENT DOCUMENTS

| | | | |
|---|---|---|---|
| 1,857,418 | 5/1932 | Wedler | 297/219.1 |
| 2,246,197 | 6/1941 | Wright . | |
| 4,557,522 | 12/1985 | Isikawa | 297/452.58 |
| 4,844,539 | 7/1989 | Selbert | 297/219.1 X |

FOREIGN PATENT DOCUMENTS

| | | | |
|---|---|---|---|
| 0223312 | 11/1985 | European Pat. Off. . | |
| 223312 | 5/1987 | European Pat. Off. | 297/228.11 |
| 1.511.646 | 2/1968 | France . | |
| 2562055 | 10/1985 | France | 297/452.59 |

*Primary Examiner*—Laurie K. Cranmer
*Attorney, Agent, or Firm*—Larson and Taylor

[57] ABSTRACT

The cover comprises a panel, a skirt (6) and a margin (7) that extend mutually one from the other and that are designed respectively to cover the top of the cushion, at least a major fraction of its flanks (3*b*), and a corresponding marginal band around its bottom (3*c*), at least the major fraction of the length of the free edge of the margin (7) being pleated and tensioned by being sewn (at 14) in a prefolded state to a non-stretch cord that extends without folds along said edge.

11 Claims, 2 Drawing Sheets

METHOD AND A COVER FOR COVERING A CUSHION OF A MOTOR VEHICLE SEAT

This application is a continuation of application Ser. No. 08/148,436 filed Nov. 8, 1993, now abandoned.

FIELD OF THE INVENTION

The present invention relates to a cover for covering a motor vehicle seat cushion, e.g. the cushion constituting the seat proper of a front seat or of a bench back seat, or the cushion of a headrest or of an armrest, and the invention also relates to a method of fitting a cover on such a cushion.

BACKGROUND OF THE INVENTION

A cushion constituting the seat proper of a seat is usually made of a deformable material such as a foam and is defined by a top, by flanks, and by a bottom that is carried by a frame. A cover of flexible material is fitted on the foam, e.g. a loose cover. The cover itself comprises a panel, a skirt, and a margin that extend mutually one from the other, and when the cover is in position on the cushion, they extend respectively over the top of the cushion, over at least a major portion of the flanks of the cushion, and over a corresponding marginal band around the bottom of the cushion. As a result, the cushion and its frame are enclosed between the panel and the margin of the cover.

To keep the margin in place over the bottom of the cushion and the frame, the free edges of the margin are generally provided with rigid rods that co-operate with complementary means carried by the frame.

An object of the invention is to provide a method and a cover for covering a cushion that avoids the need to provide such assembly rods around the outline defined by the free edges of the margin. For a manufacturer mass producing seats, this represents a considerable reduction in the number of parts and in assembly time.

Proposals have already been made in European patent EP-0 223 312 to hold the margin the cover in place on the bottom and the frame of the cushion by means of a tensioning thread passed along a channel sewn along the free edge of the margin. Once the cover has been placed on the cushion, the thread is tensioned by pulling on its ends, thereby shortening the thread and thus urging the margin against the bottom of the cushion. The free edge of the margin is under tension and is gathered along its entire length.

SUMMARY OF THE INVENTION

The present invention provides a cover for covering a cushion of a motor vehicle seat, the cushion being defined by a top, by flanks, and by a bottom, said cover itself comprising a panel, a skirt, and a margin that extend mutually one from the other and that are designed respectively to cover the top of the cushion, at least a major portion of its flanks, and a corresponding marginal band around its bottom, at least the major portion of the free edge of the margin being pleated and tensioned so as to hold the cover in place on the cushion, the cover being characterized in that the edge of the margin is pleated by sewing said edge in an already-pleated state onto a non-stretch cord that extends without folds along said edge.

The cover advantageously further includes the following features taken singly or in any technically possible combination:

the pleats in the edge are distributed along said edge at a density that varies locally so as to increase with increasing local curvature of said edge;

the skirt further includes a web or apron that also extends a portion of the panel and that has a free edge that is substantially rectilinear and that is designed to be folded down over the bottom of the cushion and that includes means for fastening to said bottom;

the assembly constituted by the skirt and its margin with the pleated edge extends over a major fraction of the outline of the main panel but does not form a closed loop, having ends that are substantially parallel and that together define at least a portion of an opening of sufficient size to enable the cover to be put into place on the cushion;

the cord extends at at least one of its ends beyond the pleated edge of the margin by a length to which are sewn and are thus assembled together at least in part the edges of portions of the panel and of the skirt that run on one from the other;

the cover covers a cushion forming a seat proper, said cushion having a front flank, a rear flank, and two side flanks;

the assembly constituted by the skirt and its margin having the pleated edge covers the front and side flanks of the cushion, the apron covering its rear flank; and the cover further includes flaps extending opposite ends of the apron or of the assembly constituted by the skirt and its margin having the pleated edge, said flaps serving to ensure that the flanks of the cushion are completely covered by the apron and the above-specified assembly.

The invention also provides a method of covering a cushion for a motor vehicle seat, which cushion is defined by a top, by flanks, and by a bottom, the cushion being covered by a cover comprising a panel, a skirt, and a margin that mutually extend one another and that are designed respectively to cover the top of the cushion, at least a major fraction of its flanks, and a corresponding marginal band around its bottom, at least the major fraction of the free edge of the margin being pleated and tensioned so as to hold the cover in place on the cushion, the method being characterized in that prior to installing the cover on the cushion the edge of the margin is pleated and sewn onto a non-stretch cord which extends without folding along said edge.

This method advantageously further includes the following features taken singly or in any technically possible combination:

the pleats are distributed along the edge of said margin at a density that varies locally so as to increase with the increasing local curvature that said edge will have once the cover has been installed on the cushion; and in a single operation, a single cord is sewn successively to the various portions of the pleated edge of the margin and to the edges of the panel and of the skirt that are to be assembled together.

BRIEF DESCRIPTION OF THE DRAWINGS

The following description of a particular implementation and embodiment of the invention is purely illustrative and non-limiting. It should be read with reference to the accompanying drawings, in which.

Figure 1:
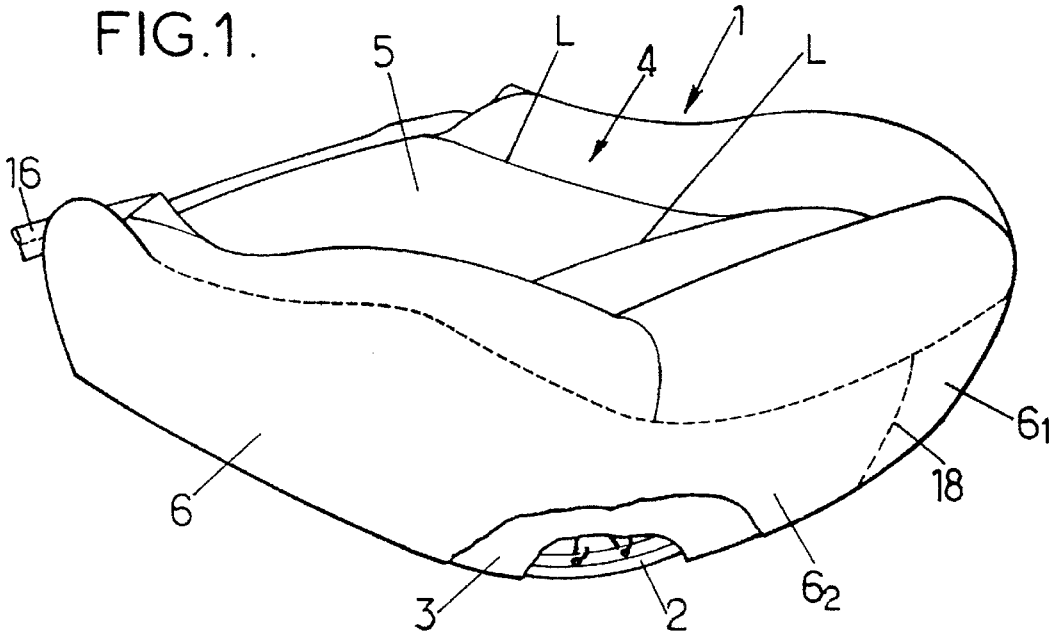
FIG. 1 is a partially cutaway perspective view of a front seat cushion for a motor vehicle covered by a cover constituting a particular embodiment of the invention.

The seat proper of a motor vehicle front seat given overall reference 1 and as shown in the figures mainly comprises a frame 2 and a foam cushion 3. The cushion 3 has a shape that is defined by a top 3*a*, front, side, and rear flanks 3*b*, and a bottom 3*c* whereby the cushion 3 is carried by the frame 2. The cushion 3 is covered by a cover 4. The cover 4 mainly comprises a panel 5 covering the top 3*a* and co-operating therewith to define a support surface on which a user sits, the cover also has a skirt 6 that is attached to the edges of the panel 5 by sewing and that covers the front and side flanks of the cushion 3.

Figure 2:
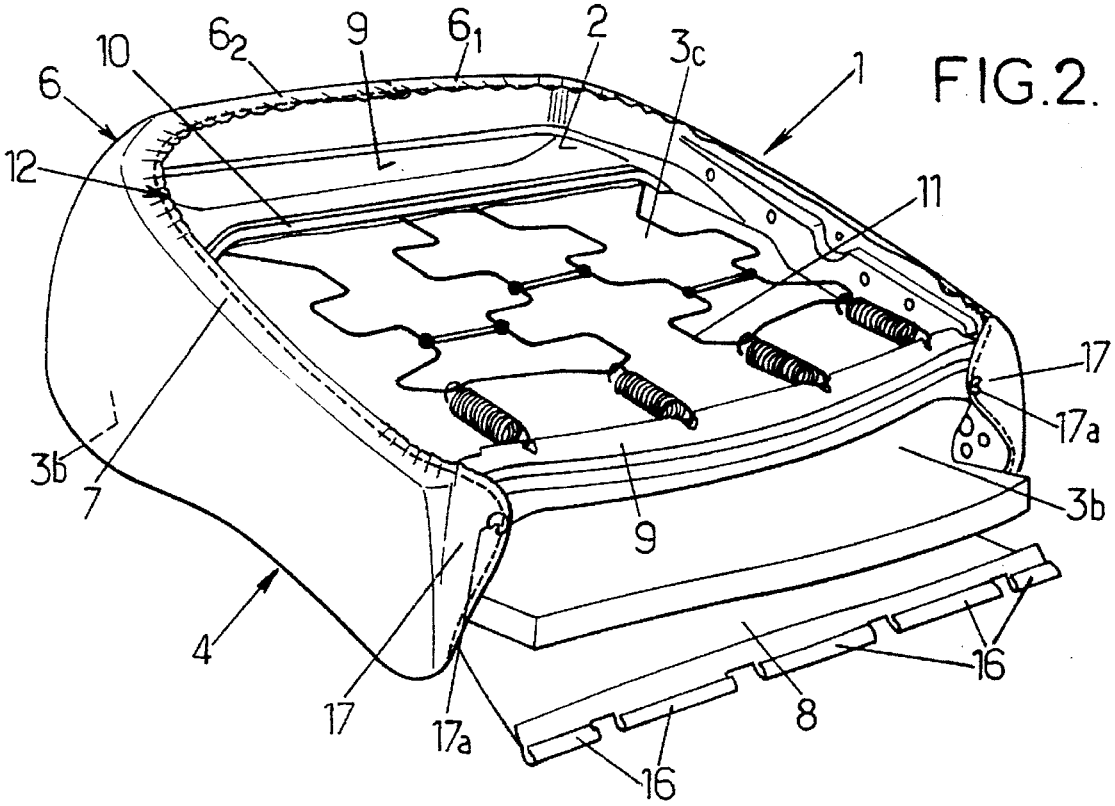
FIG. 2 is another perspective view showing the underside of the FIG. 1 cushion and its cover, which cover is shown partially installed on the cushion.

In FIG. 2, it can be seen that the cover 4 further includes an apron 8 that is independent from the skirt 6, that extends the rear edge of the panel 5, and that is designed to cover the rear flank of the cushion 3. In FIG. 2, the skirt 6 is shown in place on the cushion, while the apron 8 is shown as being in a position prior to being folded down over the bottom 3*c*.

The skirt 6 is shaped and has a margin 7 formed around its periphery with the edge of the margin being gathered and tensioned by means 12 described below that serve to hold the margin 7 pressed against the bottom 3*c* and the frame 2. FIG. 2 also shows that the frame is conventionally constructed by a metal surround 9 having at least one spacer 10 extending between the sides thereof and a set of zigzag springs 11 mounted between the spacer 10 and the surround 9.

A plurality of shaped strips 16 made of polypropylene are distributed along the free edge of the apron 8 for the purpose of engaging in complementary portions of the frame 2 so as to hold the free edge in place on the frame and the rear flank 3*b*.

Both ends of the skirt 6 are extended by respective rear flaps 17 each carrying a female press stud 17*a*. Each flap is folded sideways over the rear flank of the cushion 1, thereby adding to the covering provided by the skirt 6 and by the apron 8. The female press stud 17*a* co-operates with a complementary male stud carried by the frame 2.

Figure 3:
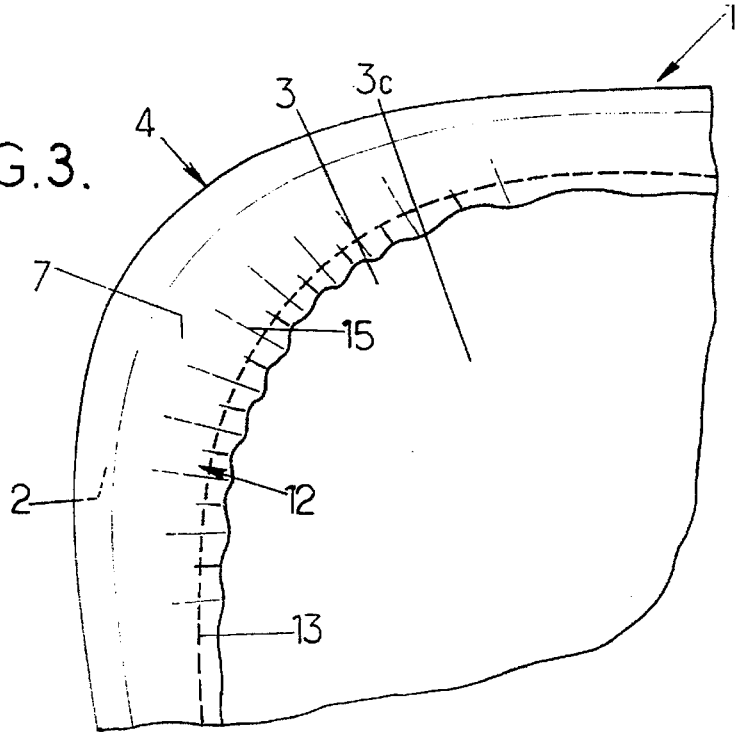
FIG. 3 is a bottom view showing a detail of the FIG. 2 cover and of the associated cushion.
Figure 4:
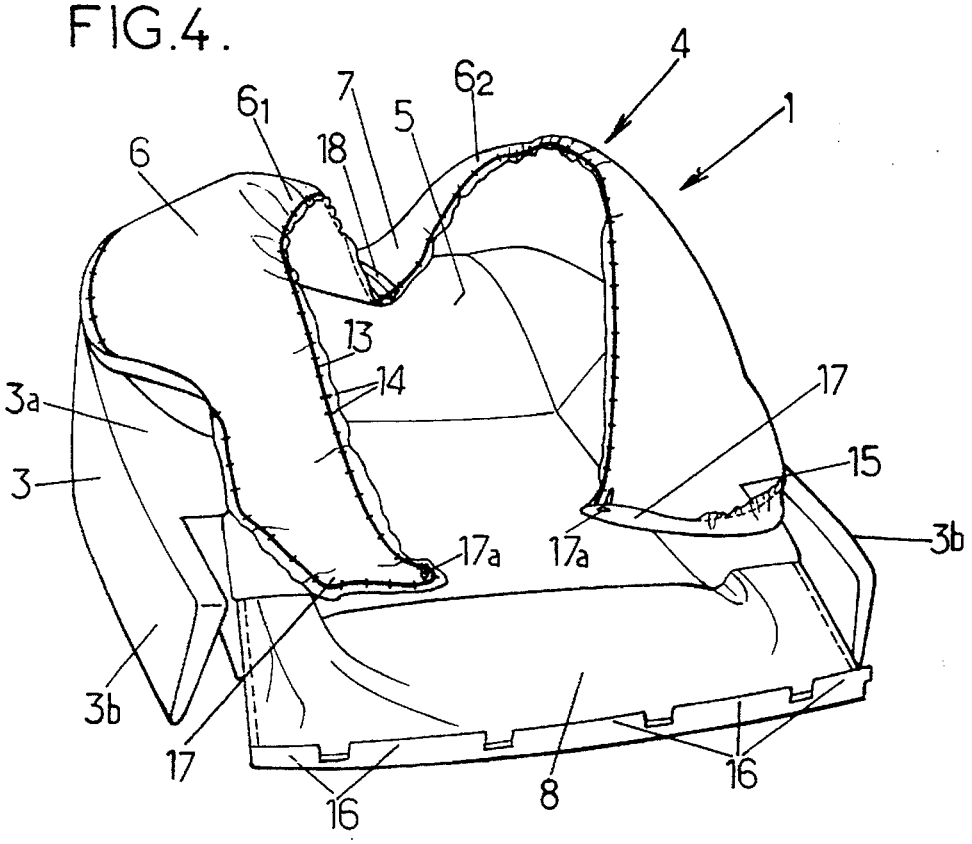
FIG. 4 is a perspective view of the cushion and of the cover shown in the above figures, prior to the skirt of the cover being put into place on the cushion.

As can be seen more particularly in FIG. 3, the gathering means 12 mainly comprise a cord 13 in the form of a braid made of a non-stretch material that extends along the edge of the margin 7 and that has the edge sewn thereto with gathering or pleats by means of pairs of lines of sewing 14 (FIG. 4) that pass through the braid 13. The gathering or pleats referenced 15 and formed in this way in the edge of the margin 7 are distributed with a density that varies locally, with density increasing as the local curvature of said edge increases.

The method of installing the cover 4 on the cushion 3 is described below.

The panel 5 overlying the seat proper is made independently from the remainder of the cover. Its face that is designed to come into contact with the top 3*a* of the cushion 3 is provided with conventional means designed to co-operate with complementary elements of the frame 2 so as to form re-entrant lines L on the load-carrying surface of the cushion.

The skirt 6 is made by being cut out from flexible material such as a plastic-coated cloth, and comprises two half-pieces $6_1$ and $6_2$. These two pieces are assembled together along a sewing referenced 18 in the figures. The apron 8 is cut out from the same material. The various outlines of the cutout portions correspond to the plane development of the respective portions of the cushion 3 that the skirt 6 and the apron 8 are designed to fit over.

A folding or pleating machine known to the person skilled in the art is used for sewing the edge of the skirt 6 that is to correspond to the free edge of the margin 7 to the braid 13, with said edge being folded firstly to give the skirt 6 a three-dimensional shape. that corresponds to the portion of the volume of the cushion 3 that the skirt 6 and its margin 7 are to fit over, and secondly so as to distribute excess material in a determined manner so that the density of folding varies locally directly as a function of the local curvature that the pleated edge will take up once the cover has been put into place on the cushion. To this end, the folding machine is programmable. It is fed simultaneously with the braid 13 and with the skirt 6 which it gathers automatically with a local reduction in size that is determined by the program contained in its memory. The way in which the pleats are distributed is determined by prior testing on templates.

Thereafter, the skirt 6 that has already been preformed in this way is sewn to the edge of the panel 5.

In an advantageous embodiment, the braid 13 extends beyond the edge of the skirt 6 and at least one of its extensions is used when sewing the panel 5 to the skirt 6. Thus, using a single machine for the above-mentioned folding machine it is possible, without interruption, to sew the skirt 6 without pleating around the panel 5 and to the braid 13, and then to sew the edge of the margin 7 of the skirt 6 with pleating to the braid 13. This operation may be performed using a braid whose portion that is sewn to the pleated edge of the margin is extended at one end only.

Another step consists in sewing bars 16 to the free edge of the apron 8, and then in sewing the apron 8 to the rear edge of the panel 5.

The cover 4 is installed on a cushion 3 firstly by assembling the panel 5 to the cushion 3, either by gluing, or by in situ molding, or else by conventional mechanical retention. The cover is then on the cushion 3 in the position shown in FIG. 4.

Once this assembly operation has been performed, the foam of the cushion is compressed mechanically. The skirt 6 is turned inside out (like putting on a sock) over the foam, and its pleated edge is placed against the frame 2. The skirt 6 is then held under tension between the braid 13 and the panel 5 bearing against the foam. The outline defined by the braid 13 lies inside the outline of the metal surround 9, such that the skirt 6 is shaped with a margin 7 that extends from the outside edge of the surround 9 to the edge that has been pleated by means of the braid 13. The cushion 3 is thus enclosed inside its cover 4.

It should be observed that in order to enable the edge that is sewn to the braid 13 to be moved without difficulty over the metal surround 9, it is necessary for this edge not to form a closed loop, for the end portions of the skirt 6 to be no more than substantially parallel to each other, and for them to co-operate to define an opening of sufficient size.

The rear flaps 17 of the skirt 6 are then closed onto the rear flank 3*b* of the cushion and they are held 5 in place by the female press studs 17*a* engaging on the complementary studs carried by the frame 2. The cover 4 is then installed on the cushion 3 in the configuration shown in FIG. 2.

Thereafter, the apron 8 is folded over the bottom as constituted by the frame 2 and is held thereto by its bars 16 co-operating with complementary portions of the frame 2 which receive them.

Positioning eyes (not shown) may be provided on either side at the rear of the frame 2 for co-operating with staples carried by the cover 4 and for facilitating centering of the cover 4.

The final appearance of the covered seat 1 is as shown in FIG. 1.

Compared with the prior art, the cover and method of the invention have the following advantages, in particular:

they provide considerable saving in component parts;

whereas in prior art techniques the pleats in the margin of the cover were distributed in a way that needed to be made uniform from one seat to another by manual action, thus excluding industrial repeatability, the pleating performed by the folding machine on the edge of the margin of the cover is accurately repeatable, such that the finish of coverings provided on mass-produced cushions is of good quality;

the tension imparted to the edge of the margin and thus to the skirt is likewise repeatable from one cushion to another;

when the edges of the panel and of the skirt are assembled together in the same operation as assembly with the braid, the line where they join has a uniform rolled and tensioned appearance without curling or waviness;

the skirt has no sharp corners at the curves in the surround of the frame, whereas such corners are common with skirts that include plastic stiffener bars;

any fraying that may appear at the pleated edge of the margin sewn to the braid is stopped by the sewing; and if the braid should be cut at some location while the seat is in use, then the edges of the skirt remain pleated at other locations since the braid is sewn to the margin by stitches along its entire length, thereby ensuring that the cover stays in place on the seat cushion.

As will be understood, the invention is not limited to the particular embodiment described, but on the contrary covers any variant that may be envisaged. In particular, the braid could be replaced by any other kind of cord that is suitable for sewing along the edge of the skirt margin, e.g. a tape or an analogous continuous strip element. The cushion that is covered need not have a frame. When the cushion being covered is other than a cushion constituting a seat proper, then the covering may be put into place without being turned inside out onto the cushion.

We claim:

1. A cover for covering a cushion of a motor vehicle seat, the cushion comprising a top, flanks and a bottom, said cover comprising:

a panel having an outer edge for covering the top of the cushion;

a skirt for covering the flanks of the cushion, said skirt having a top edge joined to said outer edge of said panel and having a bottom edge;

a margin having pleats therein, formed along the bottom edge of said skirt; and a non-stretch cord positioned on one side of said pleated margin at an edge thereof and fastened to said previously pleated margin by stitching for holding the margin against the bottom of the cushion.

2. A cover according to claim 1 wherein the pleats are distributed along the margin at a density that varies locally so as to increase with increasing local curvature of the edge of the margin.

3. A cover according to claim 1 wherein said skirt includes an opening of sufficient size to enable said cover to be placed on the cushion.

4. A cover according to claim 1 wherein said non-stretch cord extends beyond a pleated edge of the margin for attachment to at least a portion of the joined edges of the skirt and the panel.

5. A cover according to claim 1 wherein the skirt includes an apron extending from the outer edge of said panel, said apron having a substantially rectilinear free edge for folding down over the bottom of the cushion when said cover is in place on the cushion, said apron including means for fastening to the bottom of the cushion.

6. A cover according to claim 5 wherein said cushion comprises a front flank, a rear flank and two side flanks, said apron covering the rear flank of said cushion.

7. A cover according to claim 5 further comprising flaps attached to said skirt between the top and bottom edges for ensuring that rear ends of said side flanks are completely covered.

8. A cover according to claim 1 wherein said non-stretch cord comprises a braid.

9. A method of covering a cushion for a motor vehicle seat, said cushion comprising a top, flanks and a bottom, said method comprising the steps of:

constructing a cover comprising a panel and a skirt having a margin at a bottom edge;

forming pleats in said margin;

positioning a non-stretch cord on one side of said pleated margin;

fastening the pleated margin to said non-stretch cord by stitching;

attaching a top edge of said skirt to outer edges of said panel; and installing the cover on the cushion such that the panel covers the top of the cushion, the skirt covers the flanks of the cushion and the non-stretch cord holds the margin against the bottom of the cushion.

10. A method according to claim 9 wherein the step of forming comprises distributing pleats along an edge of said margin at a density that varies locally to correspond to increasing and decreasing areas of curvature of the cushion that said margin covers.

11. A method according to claim 9 further comprising the step of sewing the non-stretch cord to said top edge of said skirt and the outer edges of said panel during said step of attaching.

* * * * *